US007768463B2

(12) United States Patent
Ying et al.

(10) Patent No.: US 7,768,463 B2
(45) Date of Patent: Aug. 3, 2010

(54) ANTENNA ASSEMBLY, PRINTED WIRING BOARD AND DEVICE

(75) Inventors: Zhinong Ying, Lund (SE); Ishimiya Katsunori, Malmö (SE)

(73) Assignee: Sony Ericsson Mobile Communications AB, Lund (SE)

( * ) Notice: Subject to any disclaimer, the term of this patent is extended or adjusted under 35 U.S.C. 154(b) by 213 days.

(21) Appl. No.: 12/104,208

(22) Filed: Apr. 16, 2008

(65) Prior Publication Data

US 2009/0262023 A1 Oct. 22, 2009

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 846
See application file for complete search history.

(56) References Cited

U.S. PATENT DOCUMENTS

| | | | | |
|---|---|---|---|---|
| 6,304,220 | B1 | 10/2001 | Herve et al. | |
| 7,023,385 | B2 | 4/2006 | Harihara | |
| 7,405,697 | B2 * | 7/2008 | Ying | 343/700 MS |
| 7,466,277 | B2 | 12/2008 | Ishizuka et al. | |
| 2003/0001785 | A1 | 1/2003 | Park | |
| 2005/0231428 | A1 | 10/2005 | Iguchi et al. | |
| 2005/0243001 | A1 | 11/2005 | Miyata et al. | |
| 2008/0062045 | A1 * | 3/2008 | Dinallo et al. | 343/700 MS |

FOREIGN PATENT DOCUMENTS

| | | | |
|---|---|---|---|
| EP | 1 460 713 | A1 | 9/2004 |
| EP | 1 505 689 | A1 | 2/2005 |
| EP | 1 569 300 | A1 | 8/2005 |
| WO | WO 02/078123 | A1 | 10/2002 |
| WO | WO 2005/101571 | A1 | 10/2005 |
| WO | WO 2007/122870 | | 11/2007 |
| WO | WO 2008/030852 | | 3/2008 |

OTHER PUBLICATIONS

International Search Report and Written Opinion of the International Searching Authority corresponding to PCT/EP2008/063329, Feb. 16, 2009, 10 pages.
Co-pending U.S. Appl. No. 12/104,013 filed Apr. 16, 2008, entitled "Antenna Assembly", inventor: Zhinong Ying.

* cited by examiner

*Primary Examiner*—Hoang V Nguyen
(74) *Attorney, Agent, or Firm*—Harrity & Harrity, LLP

(57) ABSTRACT

Antenna assembly may include a dielectric substrate having a relative dielectric constant ($\in_r$) of greater than one. The dielectric substrate may include a first branch that comprises a first antenna pattern and a first ground point for connecting the first antenna pattern to a first ground. The dielectric substrate may include a second branch that may include a second antenna pattern and a second ground point for connecting the second antenna pattern to a second ground. Each antenna pattern may thereby be configured to transmit and/or receive signals within a predetermined frequency band when said antenna assembly is in use.

17 Claims, 3 Drawing Sheets

ANTENNA ASSEMBLY, PRINTED WIRING BOARD AND DEVICE

TECHNICAL FIELD

The present invention generally relates to an antenna assembly and, more particularly, to a dielectric block, a printed wiring board (PWB), and a device implementing such an antenna assembly and/or dielectric block and/or PWB.

BACKGROUND

An antenna may include a transducer (e.g., transceiver) designed to transmit and/or receive radio, television, microwave, telephone and radar signals, i.e., an antenna converts electrical currents of a particular frequency into electromagnetic waves and vice versa. Physically, an antenna is an arrangement of one or more electrical conductors that is configured to generate a radiating electromagnetic field in response to an applied alternating voltage and the associated alternating electric current, or that can be placed in an electromagnetic field so that the field will induce an alternating current in the antenna and a voltage between its terminals.

Portable wireless communication electronic devices, such as mobile phones, typically include an antenna that is connected to electrically conducting tracks or contacts on a printed wiring board (PWB) by soldering or welding. Manufacturers of such electronic devices are under commercial pressure to increasingly reduce the relative physical size, weight, and cost of the devices and improve their electrical performance. These economic constraints necessitate that the electronic device and its associated antenna should be incomplex and inexpensive to manufacture and/or assemble.

To minimize the size of an antenna for a given wavelength, a microstrip antenna (also known as a printed antenna) may be used inside a portable wireless communication electronic device. A microstrip antenna can be fabricated by etching an antenna pattern (i.e., a resonant wiring structure) on one surface of an insulating dielectric substrate having a dielectric constant ($\in_r$) greater than 1, with a continuous conducting layer, such as a metal layer, bonded to the opposite surface of the dielectric substrate that forms a ground plane. Such an antenna can have a low profile, be mechanically rugged, and relatively inexpensive to manufacture and design because of its incomplex two-dimensional geometry.

One of the most commonly employed microstrip antennas is a rectangular patch. The rectangular patch antenna is approximately a half wavelength long section of rectangular microstrip transmission line. When air is the antenna substrate, the length of the rectangular microstrip antenna is approximately half of a free-space wavelength. As the antenna is loaded with a dielectric as its substrate, the length of the antenna decreases as the relative dielectric constant of the substrate increases. That is, the wavelength of the radiation in the dielectric is shortened by a factor of $1/\sqrt{\in_r}$. An antenna including such a dielectric substrate may therefore be made shorter by a factor of $1/\sqrt{\in_r}$.

A further manufacturing challenge is to provide electronic devices with an antenna capable of simultaneously transmitting and/or receiving signals that use different wireless communication standards, such as GPS, Rx diversity, W-LAN, Wi-Fi, Bluetooth and UWB, i.e. a dual- or multi-band antenna, which is compact, and simple to manufacture and assemble.

SUMMARY

Embodiments of the present invention provide an improved antenna that is suitable for dual- or multi-band applications.

An exemplary antenna assembly may include a dielectric substrate having a relative dielectric constant ($\in_r$) greater than one (i.e., >1). The dielectric substrate may include a first branch that includes a first antenna pattern and a first ground point for connecting the first antenna pattern to a first ground. The dielectric substrate may include a second branch that includes a second antenna pattern and a second ground point for connecting the second antenna pattern to a second ground. A single dielectric substrate may thus include two isolated antenna patterns, whereby each antenna pattern is configured to (simultaneously or non-simultaneously) transmit and/or receive signals within a predetermined frequency band when the antenna assembly is in use.

Such an antenna assembly may, due to its dual/multi-band capabilities, be used to incorporate both GPS and Bluetooth functionality into a single electronic device. The antenna assembly may be operated, however, in one or more of the following frequency ranges: GPS, Rx diversity, W-LAN, Wi-Fi, Bluetooth, UWB, or any other frequency range. Furthermore, its compact size allows designers to embed it into the smallest of electronic devices. Such an antenna assembly may also replace multiple antennas that can only operate at a certain given frequency when antenna installation space is limited, thus providing a cost effective and space effective alternative to multiple antenna installations.

It should be noted that two isolated antenna patterns may also be configured to (simultaneously or non-simultaneously) transmit and/or receive signals within the same predetermined frequency band when the antenna assembly is in use.

It will be appreciated that when the antenna assembly according to any of the embodiments of the invention is included in a small portable radio communication device, such as a mobile phone, it may partially contribute to the transmission or reception of the radio waves transmitted or received by the device. Other large, electrically conductive components of the device, such as its chassis, its battery, or PWB may also influence the transmission and/or reception of radio signals. The antenna patterns of the antenna assembly may be capacitively and/or inductively coupled to the mass blocks in such a way that the complete antennas (i.e. the antenna assemblies and the mass blocks) are provided with the desired impedance. Consequently, a component that is normally considered to be an "antenna," in fact, may function as an exciter for such mass blocks and may have, therefore, been designated an "antenna assembly" rather than an "antenna." The expression, "antenna," as used herein, may include components that may be considered to be "antenna assemblies" rather than "antennas."

According to an embodiment of the invention, a dielectric substrate may include more than two branches, wherein each branch may include an antenna pattern and a separate ground point for connecting the antenna pattern to a separate ground.

According to an embodiment of the invention, the branches may be configured to extend from a common point.

According to an embodiment of the invention, the first and second branches, or two branches of the dielectric substrate including more than two branches, may be configured to form an L-shape. Such orthogonal positioning may provide good isolation between the two antenna patterns. Furthermore, an L-shaped dielectric substrate may be mounted in a corner of a printed wiring board (PWB), thus facilitating the mounting of the antenna assembly. A dielectric substrate may include, however, branches located at any angle with respect to adjacent branches or an adjacent branch.

According to an embodiment of the invention, each antenna pattern may include a feed point for connecting the antenna pattern to a feed line (i.e. a medium for conveying signal energy from a signal source to the antenna assembly) and the feed point is preferably, but not necessarily, located at a distal end of a branch.

According to another embodiment of the invention, the ground points may be disposed at a junction of the first and second branches, or two or more branches of the dielectric substrate.

According to another embodiment of the invention, a dielectric substrate may include a ceramic material having a high magnetic permeability ($\mu$), such as ferrite, or any other material having a relative dielectric constant ($\in_r$) greater than one (i.e., >1).

According to another embodiment of the invention, at least two branches of a dielectric substrate may have different relative dielectric constants ($\in_r$), i.e., the relative dielectric constant ($\in_r$) of the dielectric substrate of an antenna assembly according to the present invention may be either uniform or non-uniform throughout the dielectric substrate. The relative dielectric constant ($\in_r$) of each branch, or of any number of branches of the dielectric substrate may be adjusted as desired, for example, by embedding a different amount or a different type of ceramic powder in a polymer matrix constituting part of a branch on manufacture of the dielectric substrate.

According to an embodiment of the invention, each antenna pattern, or two branches of a dielectric substrate including more than two branches, may be configured to transmit and/or receive signals within a different frequency band when the antenna assembly is in use. Alternatively, each antenna pattern or at least two branches of a dielectric substrate including more than two branches, may be configured to transmit and/or receive signals within the same frequency band to increase the number of communication channels within a particular frequency band.

According to another embodiment of the invention, a dielectric substrate may include three branches that are configured to form a T-shape. Alternatively, the dielectric substrate may include four branches that are configured to form a cross whereby each branch is orthogonally located with respect to the branches adjacent thereto.

Embodiments of the present invention provide a printed wiring board (PWB) including an antenna that may include an antenna assembly according to any of the embodiments of the invention. A PWB may include a plurality of antenna assemblies according to the same or different embodiments of the invention.

The expression, printed wiring board, or PWB (also called printed circuit board (PCB)), as used herein, may include any flexible or non-flexible, planar or non-planar, substantially non-electrically-conductive substrate that is used to mechanically support at least one microchip or other electronic component, and/or to electrically connect components supported thereon and/or connected thereto using conductive pathways etched/printed/engraved or otherwise provided thereon.

According to an embodiment of the invention, and antenna assembly may be located with at least one branch of a dielectric substrate extending along one edge of a PWB. Alternatively, the antenna assembly may be located in a corner of the PCB with one branch of the dielectric substrate extending along one edge of the PWB and another branch of the dielectric substrate extending along another edge of the PWB. Positioning an antenna assembly in a corner of the PCB may facilitate the manufacture and/or assembly of an antenna. An antenna assembly may be disposed, however, at any position on a PWB.

According to another embodiment of the invention, a PWB may include a ground plane and a plurality of ground pads for connection to the ground plane and to the ground points of the antenna assembly, whereby the connection between each ground pad and the ground plane may include a different capacitive and/or inductive coupling, i.e., a different LC load, to enable each antenna pattern of the antenna assembly to operate at a different resonant frequency and consequently transmit and/or receive signals within a different frequency band when the antenna assembly is in use. Alternatively, the connection between each ground pad and the ground plane may include the same capacitive and/or inductive coupling to enable at least two of the antenna patterns of the antenna assembly to operate at the same resonant frequency and consequently transmit and/or receive signals within the same frequency band when the antenna assembly is in use to increase the number of operable communication channels within a particular frequency band.

It will be appreciated that any number of frequency bands may be implemented using the antenna assembly and/or PWB according to the present invention.

According to a further embodiment of the invention, the antenna assembly may be integrally formed with the PWB, whereby the manufacture of a complete PWB including an antenna assembly may be integrated into one manufacturing step, thereby reducing the assembly time, costs, and complexity.

Embodiments of the present invention may provide a device that includes an antenna assembly or a printed wiring board according to any of the embodiments of the invention. The electronic device may be a portable or non-portable device, such as a telephone, media player, Personal Communications System (PCS) terminal, Personal Data Assistant (PDA), laptop computer, palmtop receiver, camera, television, radar, or any appliance that includes a transducer (e.g., transceiver) designed to transmit and/or receive radio, television, microwave, telephone, and/or radar signals. The antenna assembly, dielectric substrate, and PCB according to the present invention may, however, be intended for use particularly, but not exclusively, for high frequency radio equipment.

BRIEF DESCRIPTION OF THE DRAWINGS

The present invention will hereinafter be further explained by means of non-limiting examples with reference to the appended schematic figures.

It should be noted that the drawings have not necessarily been drawn to scale and that the dimensions of certain features may have been exaggerated for the sake of clarity.

DETAILED DESCRIPTION OF EMBODIMENTS

Figure 1:
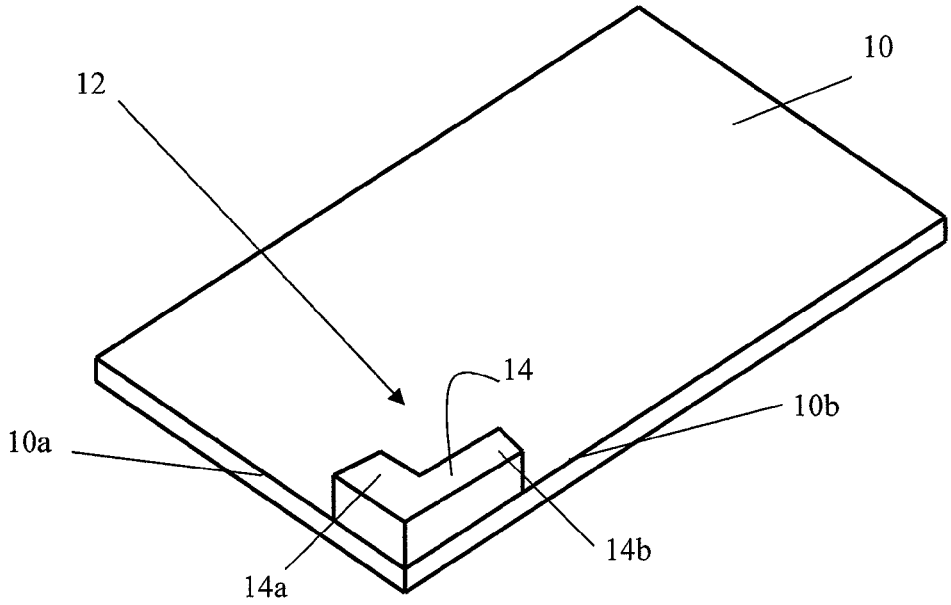
FIG. 1 shows a printed wiring board according to an embodiment of the invention.

FIG. 1 shows a printed wiring board (PWB) 10 including an antenna assembly 12 located in a corner thereof. Antenna assembly 12 may include a single- or multi-layer dielectric substrate 14 having a relative dielectric constant ($\in_r$) of greater than one (i.e., >1). Dielectric substrate 14 may include, for example, a PTFR (polytetrafluoroethylene)/fiberglass composite or any other suitable dielectric material having a relative dielectric constant ($\in_r$) of greater than one and up to twenty or more, for example.

Dielectric substrate 14 in the illustrated embodiment is shown as a rectangular block. It should be noted, however, that dielectric substrate 14 may be of any shape and may have any number of branches. Dielectric substrate 14 and/or a branch of dielectric substrate 14 may be, for example, square, circular, triangular, or an elliptical cross section, or have any other regular or non-regular geometric form. Dielectric substrate 14 could have, for example, a cylindrical form on which a helical antenna pattern may be deposited or otherwise provided.

PWB 10 and antenna assembly 12 may be integrally formed as a single unit. Alternatively, antenna assembly 12 may be mounted on PWB 10 by any conventional means, such as soldering or spot welding.

Figure 2:
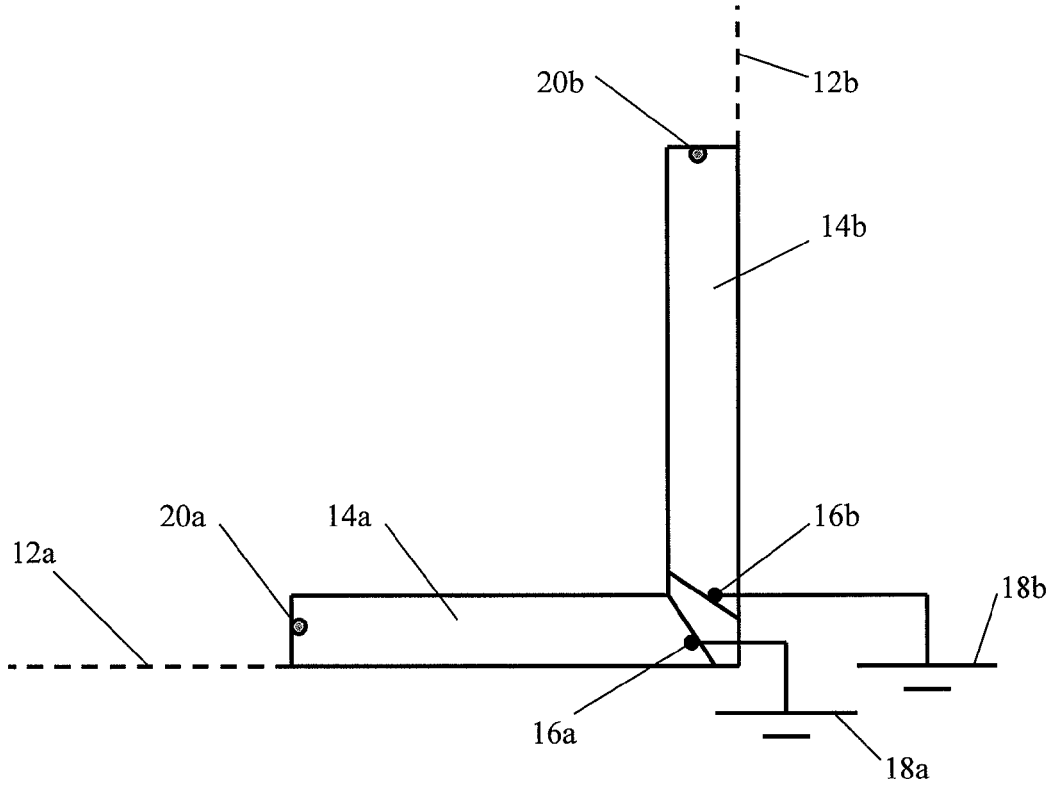
FIG. 2 is an overhead view of an antenna assembly according to an embodiment of the invention.

FIG. 2 is an overhead view of the bottom right-hand corner of PWB 10 shown in FIG. 1. A first branch 14*a* of dielectric substrate 14 may include a first antenna pattern, such as a helical pattern (not shown in FIGS. 1 or 2) and have a first predetermined electric length and width to provide the desired antenna functionality, and a first ground point 16*a* for connecting the first antenna pattern to a first ground 18*a*. A second branch 14*b* of dielectric substrate 14 may include a second antenna pattern (not shown in FIGS. 1 or 2) and have a second predetermined electric length and width to provide the desired antenna functionality and a second ground point 16*b* for connecting the second antenna pattern to a second ground 18*b*. The antenna patterns may be provided on/inside dielectric substrate 14 using a lithographic technique for example, and their electric length may be set to correspond to a certain fraction of the wavelength at the signal resonance frequency, such as a half wavelength.

It should be noted that first and second branches 14*a* and 14*b* of an antenna assembly according to any of the embodiments of the invention may be branched or un-branched, i.e., the branches may themselves include branches.

Each antenna pattern may thereby be configured to simultaneously or non-simultaneously transmit and/or receive signals within a predetermined frequency band when the antenna assembly is in use. Each antenna pattern may be configured, for example, to transmit and/or receive signals within the same, or a different frequency band when the antenna assembly is in use.

In the illustrated embodiment, separate ground points 18*a*, 18*b* may be disposed at a junction of first and second branches 14*a*, 14*b*. Each antenna pattern may include a feed point 20*a*, 20*b* for connecting each antenna pattern to a separate feed line (not shown), whereby feed points 20*a*, 20*b* may be disposed at the distal ends of branches 14*a*, 14*b* in the embodiment illustrated in FIG. 2. It should be noted that ground points 16*a*, 16*b* and feed points 20*a*, 20*b* need not necessarily be located on the top surface of dielectric substrate 14 or at the ends of each branch 14*a*, 14*b* of dielectric substrate 14 as shown in FIG. 2, but can be located anywhere in/on and along dielectric substrate 14.

Figure 5:
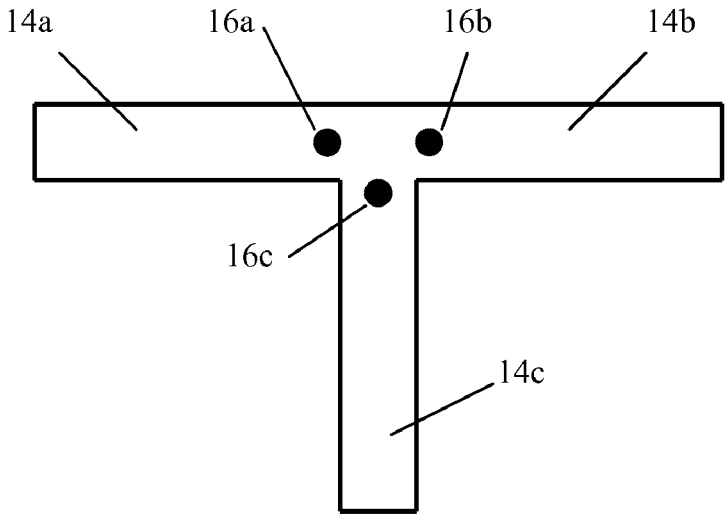
FIG. 5 is an overhead view of an antenna assembly according to an embodiment of the invention.
Figure 6:
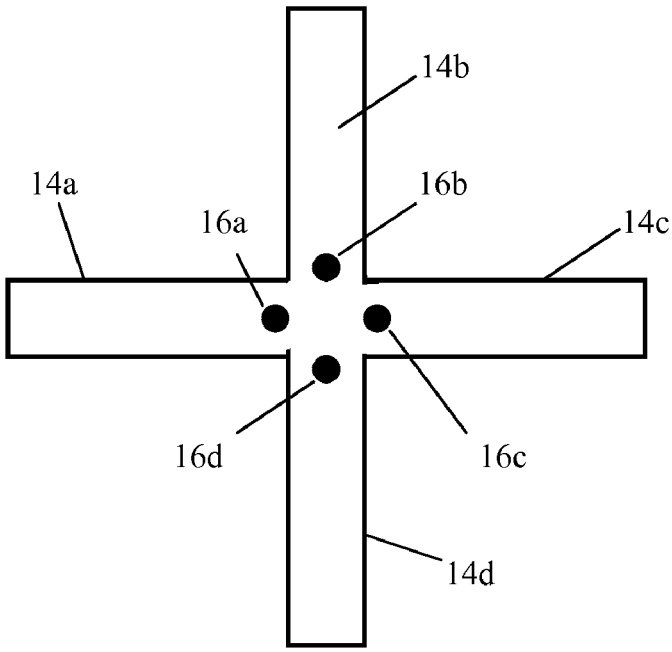
FIG. 6 is an overhead view of an antenna assembly according to an embodiment of the invention.

Dielectric substrate 14 may include more than two branches that are configured to extend from a common point. For example, as shown in FIG. 5, dielectric substrate 14 may include three branches 14*a*, 14*b*, 14*c* that are configured to form a T-shape and have separate ground points 16*a*, 16*b*, 16*c*, and/or, as shown in FIG. 6, it may include four branches 14*a*, 14*b*, 14*c*, 14*d*, that are configured to form a cross and have separate ground points 16*a*, 16*b*, 16*c*, 16*d*, whereby each branch is orthogonally located with respect to the branches adjacent thereto. However, the branches of dielectric substrate 14 need not necessarily be orthogonally located with respect to the branch/branches adjacent thereto, but may be arranged at any angle with respect to one another.

Figure 3:
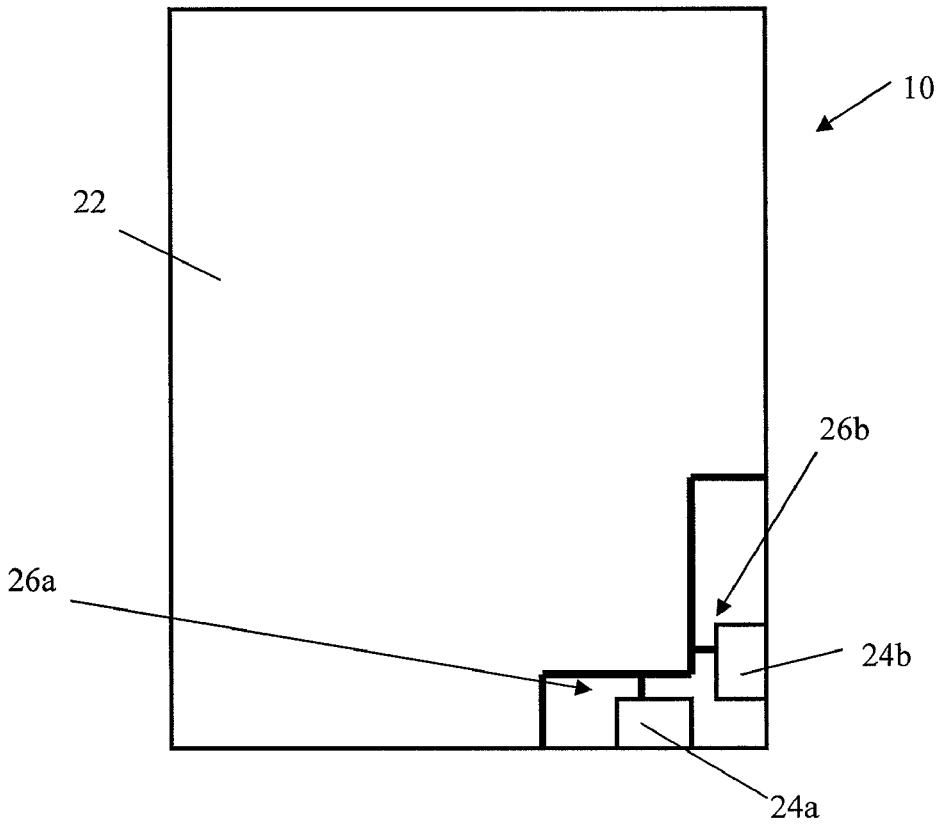
FIG. 3 shows the top surface of a printed circuit board according to an embodiment of the invention.

FIG. 3 shows the top surface of PWB 10 illustrated in FIGS. 1 and 2. PWB 10 may include a ground plane 22 and a plurality of ground pads 24*a*, 24*b*, such as metal traces, for connection to ground plane 22 and to ground points 16*a*, 16*b* of antenna assembly 12. Ground pads 24*a*, 24*b*, may be disposed on the surface of PWB 10 and/or may be suspended above ground plane 22 using dielectric spacers. Connection 26*a*, 26*b* between each ground pad 24*a*, 24*b* and ground plane 22 may include a different capacitive and/or inductive coupling, i.e., a different LC load, to enable each antenna pattern of antenna assembly 12 to operate at different resonant frequencies and consequently transmit and/or receive signals within a different frequency band when the antenna assembly is in use.

Figure 4:
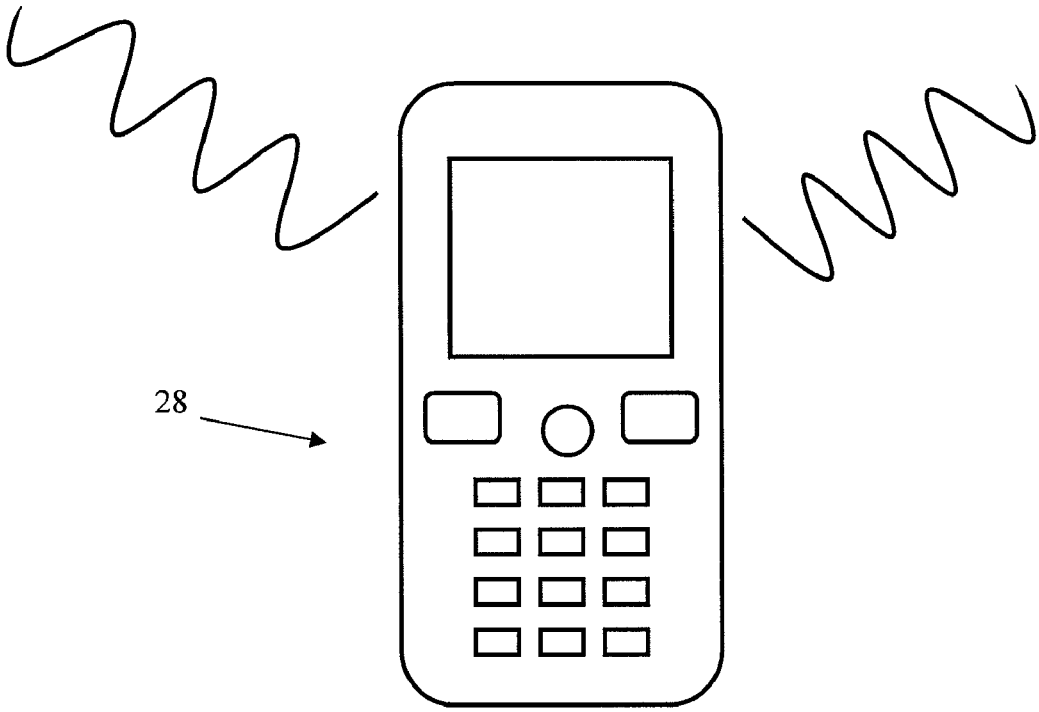
FIG. 4 shows an electronic device according to an embodiment of the invention.

FIG. 4 shows an electronic device 28, for example, a mobile telephone, according to an embodiment of the invention. Electronic device 28 may include antenna assembly 12 or PWB 10 (not shown in FIG. 4) according to any of the embodiments of the invention.

Further modifications of the invention within the scope of the claims would be apparent to a skilled person. For example, a PWB may include circuitry to enable a user to switch between different antenna assemblies or between different antenna patterns of an antenna assembly and thereby select the frequency band of transmitted and/or received signals and the number of communication channels in use.

What is claimed is:

1. An antenna assembly comprising:

a dielectric substrate having a relative dielectric constant ($\in_r$) of greater than one, the dielectric substrate including:

a first branch that includes a first antenna pattern and a first ground point for connecting the first antenna pattern to a first ground, and a second branch that includes a second antenna pattern and a second ground point for connecting the second antenna pattern to a second ground, wherein the first antenna pattern and the second antenna pattern are configured to at least one of operatively transmit or operatively receive signals within a predetermined frequency band, and wherein the first antenna pattern and the second antenna pattern comprise a first feed point and a second feed point, respectively, to connect the first antenna pattern and the second antenna pattern to a feed line, and the first feed point is disposed at a distal end of the first branch and the second feed point is disposed at a distal end of the second branch.

2. The antenna assembly of claim 1, wherein the dielectric substrate further comprises a third branch, wherein each of the first, second, and third branches comprises an associated antenna pattern and a separate ground point for connecting the associated antenna pattern to a separate ground.

3. The antenna assembly of claim 2, wherein the first, second, and third branches form a T-shape.

4. The antenna assembly of claim 2, wherein the dielectric substrate further comprises a fourth branch, wherein each of the first, second, third, and fourth branches is orthogonally located with respect to other ones of the branches adjacent thereto.

5. The antenna assembly of claim 1, wherein the first and second branches are configured to extend from a common point.

6. The antenna assembly of claim 1, wherein the first and second branches are configured to form an L-shape.

7. The antenna assembly of claim 1, wherein said ground points are located at the junction of said first and second branches, or two or more branches of said dielectric substrate.

8. The antenna assembly of claim 1, wherein the dielectric substrate comprises a ceramic.

9. The antenna assembly of claim 1, wherein the first and second branches of the dielectric substrate have relative dielectric constants ($\in_r$) that differ.

10. The antenna assembly of claim 1, wherein the first antenna pattern and the second antenna pattern are configured to at least one of operatively transmit or operatively receive signals within a frequency band that differs.

11. A printed wiring board (PWB) comprising:

an antenna including:

a dielectric substrate having a relative dielectric constant ($\in_r$) of greater than one, the dielectric substrate including:

a first branch that includes a first antenna pattern and a first ground point for connecting the first antenna pattern to a first ground, and a second branch that includes a second antenna pattern and a second ground point for connecting the second antenna pattern to a second ground, wherein the first antenna pattern and the second antenna pattern are configured to at least one of operatively transmit or operatively receive signals within a predetermined frequency band;

a ground plane; and a plurality of ground pads for connection to the ground plane and to the first and second ground points, wherein the connection between each ground pad and the ground plane includes a different capacitive or inductive coupling to enable the first antenna pattern and the second antenna pattern to at least one of operatively transmit or operatively receive signals within a frequency band that differs.

12. The PWB of claim 11, wherein at least one of the first branch or the second extends along a first edge of the PWB.

13. The PWB of claim 12, wherein the antenna is disposed in a corner of the PCB with one of the first branch or the second branch extending along a first edge of the PWB and another one of the first branch or the second branch extending along a second edge of the PWB.

14. The PWB of claim 11, wherein the antenna is integrally formed with the PWB.

15. An electronic device, comprising:

an antenna assembly including:

a dielectric substrate having a relative dielectric constant ($\in_r$) of greater than one, the dielectric substrate including:

a first branch that includes a first antenna pattern and a first ground point for connecting the first antenna pattern to a first ground, and a second branch that includes a second antenna pattern and a second ground point for connecting the second antenna pattern to a second ground, wherein the first antenna pattern and the second antenna pattern are configured to at least one of operatively transmit or operatively receive signals within a predetermined frequency band, and the first and second ground points are located near a junction of the first and second branches.

16. The electronic device of claim 15, wherein the dielectric substrate further comprises:

a third branch including a third antenna pattern and a third ground point for connecting the third antenna pattern to a third ground, wherein the first, second, and third branches are configured in a T-shape.

17. The electronic device of claim 15, wherein the dielectric substrate further comprises:

a third branch including a third antenna pattern and a third ground point for connecting the third antenna pattern to a third ground, and a fourth branch including a fourth antenna pattern and a fourth ground point for connecting the fourth antenna pattern to a fourth ground, wherein the first, second, third, and fourth branches are configured in a shape of a cross, and each of the four branches is orthogonally located with respect to other ones of the branches adjacent thereto.

* * * * *